US005626036A

United States Patent [19]

Koeberle

[11] Patent Number: 5,626,036

[45] Date of Patent: May 6, 1997

[54] PROCESS FOR THE PRODUCTION OF OXYGEN BY CRYOGENIC DISTILLATION

[75] Inventor: Yves Koeberle, le Perreux sur Marne, France

[73] Assignee: L'Air Liquide Societe Anonyme pour l'Etude et l'Exploitation des Procedes Georges Claude, Paris, France

[21] Appl. No.: 408,084

[22] Filed: Mar. 23, 1995

[30] Foreign Application Priority Data

Aug. 29, 1994 [FR] France ..... 94 10364

[51] Int. Cl.[6] ..... F25J 3/00

[52] U.S. Cl. ..... 62/646; 62/654

[58] Field of Search ..... 62/24, 41, 646, 62/654

[56] References Cited

U.S. PATENT DOCUMENTS

| | | | |
|---|---|---|---|
| 4,303,428 | 12/1981 | Vandenbussche | 62/41 |
| 4,702,757 | 10/1987 | Kleinberg | 62/24 |
| 5,341,646 | 8/1994 | Agrawal et al. | 62/25 |
| 5,440,884 | 8/1995 | Bonaquist et al. | 62/22 |
| 5,456,083 | 10/1995 | Hogg et al. | 62/25 |

FOREIGN PATENT DOCUMENTS

| | | |
|---|---|---|
| 0556516 | 8/1993 | European Pat. Off. . |
| 0584419 | 3/1994 | European Pat. Off. . |

*Primary Examiner*—Ronald C. Capossela
*Attorney, Agent, or Firm*—Robert D. Touslee

[57] ABSTRACT

Process for the production of oxygen by cryogenic distillation of a supply mixture containing oxygen and nitrogen in a double column (5) comprising a medium pressure column (6) and a low pressure column (7), in which there is partially condensed at least one fraction of the supply mixture in a condenser (8) by vaporization of liquid oxygen from the base of the low pressure column (7), said partially condensed mixture is sent to the medium pressure column (6), all the oxygen destined to form the gaseous production being withdrawn in liquid phase from the base of the low pressure column (7), and brought to its utilization pressure.

9 Claims, 4 Drawing Sheets

PROCESS FOR THE PRODUCTION OF OXYGEN BY CRYOGENIC DISTILLATION

Figure 1:
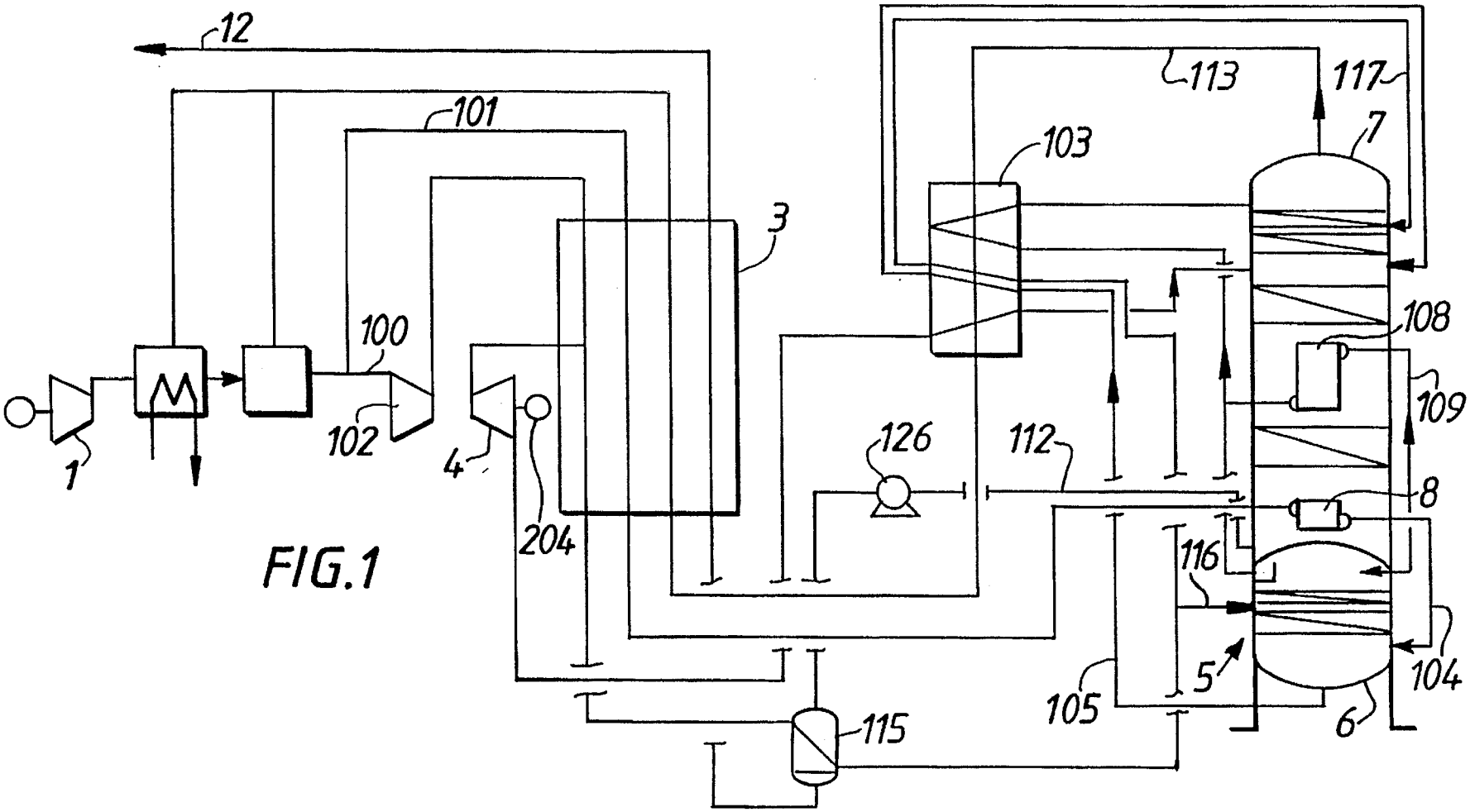

The present invention relates to a process for the production of oxygen by distillation of air and, in particular, for the production of impure oxygen.

It relates to processes for the production of oxygen by air distillation in a double column comprising a medium pressure column and a low pressure column, which columns are in heat exchange relation by means of two vaporizers/condensers, a principal vaporizer vaporizing the oxygen from the base of the low pressure column by condensation of a fraction of supplied air before its introduction into the double column, and an intermediate vaporizer condensing the nitrogen from the head of the medium pressure column by vaporization of a liquid from an intermediate level of the low pressure column.

Processes described in the prior art (U.S. Pat. Nos. 3,113,854; 3,210,951; JP-A-61-259 077) have the advantage, relative to a conventional double column with a single vaporizer, of reducing the pressure of the air sent to the medium pressure column and thus reducing the compression energy of the air sent to the columns.

The means used consist in totally condensing (U.S. Pat. No. 3,210,951) a first supplied air fraction to the pressure of the medium column, vaporizing all the oxygen from the base of the low pressure column, production included, the liquid air thus produced being sent to the double column, and supplying the medium pressure column with a second supply air fraction cooled to about its dew point.

Another means used (U.S. Pat. No. 3,113,854) consists in vaporizing all the oxygen from the base of the low pressure column by all the supplied air, which is partially condensed and sent to the medium pressure column. The advantage of this solution relative to the preceding one is to reduce the mean temperature of condensation of the air and hence its oxygen pressure, from which there is a gain in the compression energy relative to the preceding process. Upon condensing about 37% of the first fraction of the air, the pressure of the medium pressure column can be reduced to 65 psia ($4.5\times10^5$ Pa). The refrigeration needed by the system is supplied by a nitrogen turbine.

Another means proposed (JP-A-61-259 077) again produces a gain in compression energy of the air relative to the preceding process to the extent the principal vaporizer vaporizes only the reboiling oxygen of the low pressure column, the production being withdrawn in liquid phase. Unfortunately, all the supplied air is not sent to the principal vaporizer. A portion of this air is sent to the base of the medium pressure column through an expansion valve, which shows that the air is compressed to a pressure higher than that of the medium pressure column. Under these conditions, the fraction of air sent to the principal vaporizer is less condensed than it would be if all the oxygen were vaporized but more condensed than if all the supply air were utilized.

U.S. Pat. No. 4,582,518 discloses a low energy process for the production of high purity nitrogen and impure oxygen based on the same principle, of partially condensing the medium pressure air in the base of a low pressure column operating at about 4 bars, but using the impure oxygen (20% $N_2$) produced in the base of the low pressure column to augment the reflux at the head of this column by vaporization under low pressure in a head condenser of the low pressure column.

The object of the present invention is to reduce the expenditure of energy of a process for the production of oxygen under pressure relative to known processes.

According to the invention, in a process for the production of oxygen by cryogenic distillation of a supplied mixture containing oxygen and nitrogen in a double column comprising a medium pressure column and a low pressure column, there is condensed at least one fraction of the supplied mixture in a condenser by vaporization of liquid oxygen in the base of the low pressure column, said partially condensed mixture is sent to the medium pressure column, all the oxygen destined to comprise the gaseous production being withdrawn in liquid phase from the base of the low pressure column and the withdrawn oxygen in liquid phase is compressed to its utilization pressure.

It is desirable to operate the low pressure column in the vicinity of atmospheric pressure.

Preferably, there is condensed less than 30% of the supplied mixture before sending it to the medium pressure column, or, even better, less than 25% of this mixture.

It may be advantageous to partially condense in the condenser either all the mixture destined for the medium pressure column or all the mixture.

An installation for the production of oxygen by cryogenic distillation from a supplied mixture containing oxygen and nitrogen, comprises a double column with a medium pressure column and a low pressure column, means to send a first fraction of the mixture to a condenser adapted to condense partially at least one portion of said fraction by heat exchange with the liquid oxygen in the base of the low pressure column, means to withdraw in liquid phase all the oxygen destined to constitute the gaseous production from the bottom of the low pressure column, means to send said fraction of the mixture to the medium pressure column and means to compress the oxygen withdrawn in liquid phase to its utilization pressure.

The low pressure column can operate in the vicinity of atmospheric pressure.

Four examples of operation of the invention will now be disclosed with respect to the accompanying drawings, in which FIGS. 1, 2, 3 and 4 show schematically four embodiments of installation for practicing the method for the distillation of air according to the invention.

Considering FIG. 1, a process utilizes a double column 5, whose medium pressure column 6 is only at $3.3\times10^5$ Pa and the low pressure column 7 is only at $1.3\times10^5$ Pa.

The air to be treated is compressed to $3.5\times10^5$ Pa by an air compressor 1. After being cooled to ambient temperature and purified, the air is divided into two portions 100, 101.

The first fraction (62%) of supply air 101 passes through all the principal exchanger 3 before being introduced into the vaporizer 8 constituting the principal vaporizer of the double column 5. This vaporizer serves partially to condense the second portion of the supply air by heat exchange with impure oxygen, contained in the base of the low pressure column 7. Generally, only about 18% of the first fraction is condensed. The partially condensed air passes through the conduit 104 to the lower portion of the medium pressure column 6 there to be distilled.

The second portion 100 (38%) of the compressed air is sent to a supercharger 102 and then to the principal exchanger 3 before being divided into two flows. A flow constituting 10% of the compressed air is partially cooled and sent to a turbine 4 (with a brake 204) which expands it to the pressure of the low pressure column 7.

The second flow (28%) of the compressed air pursues its cooling in exchanger 3 before totally condensing in an auxiliary vaporizer 115 outside the column 5 by heat exchange with the liquid oxygen withdrawn from the base of the low pressure column 7. The liquid oxygen is pressurized by its hydrostatic head.

Nevertheless, in the illustrated example, it could be pressurized by a pump 126 (shown in broken lines) as needed by the client. The condensed air is sent into the medium and low pressure columns 6, 7 by conduits 116, 117, respectively.

The air separates in the medium pressure column 6 to produce in the base a fraction of liquid rich in oxygen and at the head a gas enriched in nitrogen. The rich liquid is sent to the low pressure column 7 through the conduit 105, after subcooling in the exchanger 103. This rich liquid is injected at the level of the point of introduction of the blown air, the head gas is withdrawn through the conduit 109 and sent to a second vaporizer 108 where it condenses, condensed liquid being returned partially to the upper part of the medium pressure column 5, through the conduit 106, to serve as reflux. The other portion of the condensed liquid is sub-cooled in the exchanger 103 before being injected at the head of the low pressure column 7 to serve as reflux.

The second vaporizer 108 is effective to condense the head gas enriched in nitrogen, because the liquid which it vaporizes contains only 80% of oxygen.

In an apparatus for practicing the method according to the invention, as shown in FIG. 1, the pressure of the medium pressure column is reduced, by withdrawing production oxygen in liquid phase, which has the effect of condensing even more partially a first portion of the air destined for the medium pressure column 6 in the vaporizer in the base of the low pressure column 7, the oxygen produced in liquid phase is vaporized at the utilization pressure while condensing totally a second portion of the air outside the column 5.

It will be seen that in the apparatus of FIG. 1 of U.S. Pat. No. 3,113,854, the total quantity of condensed air sent to the double column 5 is substantially the same, because in FIG. 1, the percentage of condensed air is about 38% (=28%+18% of 62%), the quantity of condensed air sent to the low pressure column 7 through the conduit 117 being less.

The system of FIG. 1 of the accompanying drawings permits reducing further the pressure of the medium pressure column 6 and hence that of the output of the compressor 1. As the quantity of liquid oxygen to be vaporized in the base of the low pressure column is reduced by withdrawal of liquid oxygen toward the auxiliary vaporizer 115, the condensation of air in the vaporizer 8 is reduced and can therefore take place at a lower temperature, and hence a lower pressure. The output pressure of the condenser 1 therefore falls to $3.5\times10^5$ Pa according to the embodiment of FIG. 1, by means of investment in the auxiliary vaporizer. This pressure is therefore $1.1\times10^5$ Pa lower than that of the compressor of U.S. Pat. No. 3,113,854.

Moreover the air leaves the compressor 1 at a lower temperature and hence the size of the cooling system can be reduced.

The process of the present invention permits producing oxygen with a very low specific consumption comprised between 0.25 and 0.30 $kW/Nm^3$ of pure oxygen, which consumption is a function of the purity of the oxygen and of the size of the air separation unit. The example of FIG. 1 gives an energy of 0.25 $kW/Nm^3$.

The vaporizer 8 is preferably of the type disclosed in EP-A-130 122 but could if desired be replaced by a bath vaporizer.

Figure 2:
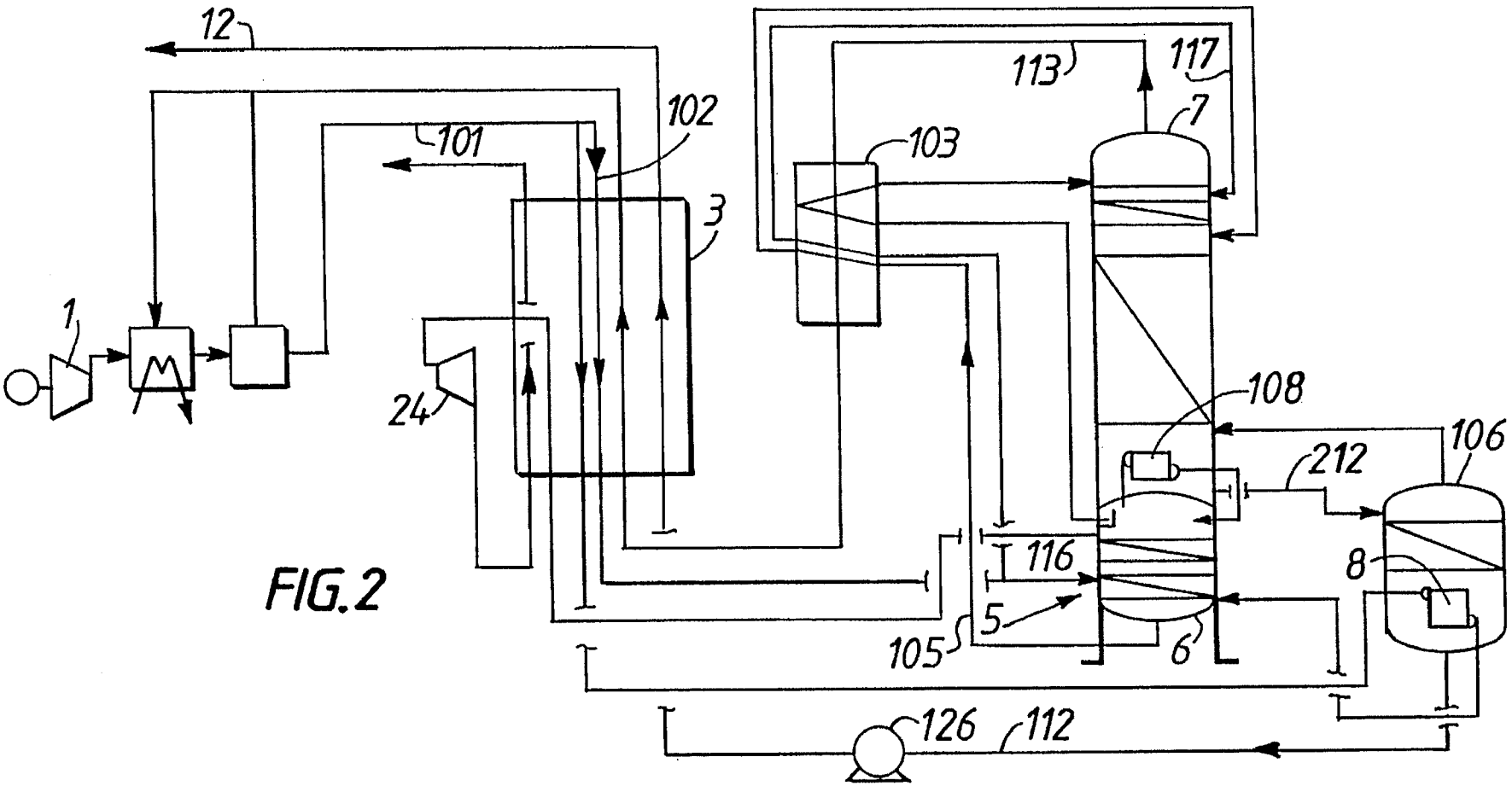

In a modification of the apparatus according for practicing the method to the invention, shown in FIG. 2, the first portion of the air partially condenses in a base condenser of an auxiliary column 206, which operates at the pressure of the low pressure column 7, before being sent to the medium pressure column 6. The auxiliary column 206 is supplied by impure liquid oxygen from the base of the low pressure column 7.

This variant permits modifying a double column already in use, to practice the invention.

In this variant, the second portion of the super-charged air (102) condenses, not in an independent vaporizer, as in FIG. 1, but in the principal exchanger 3 by heat exchange with the liquid oxygen pumped by the pump 126. The air thus condensed is sent to the columns 6, 7 through conduits 116, 117, respectively. Thus, all the air destined for distillation is either partially condensed in condenser 8, or totally condensed.

The cold needed by the apparatus is supplied by an expansion turbine 24 for medium pressure nitrogen and the suction turbine of FIG. 1 is omitted.

Figure 3:
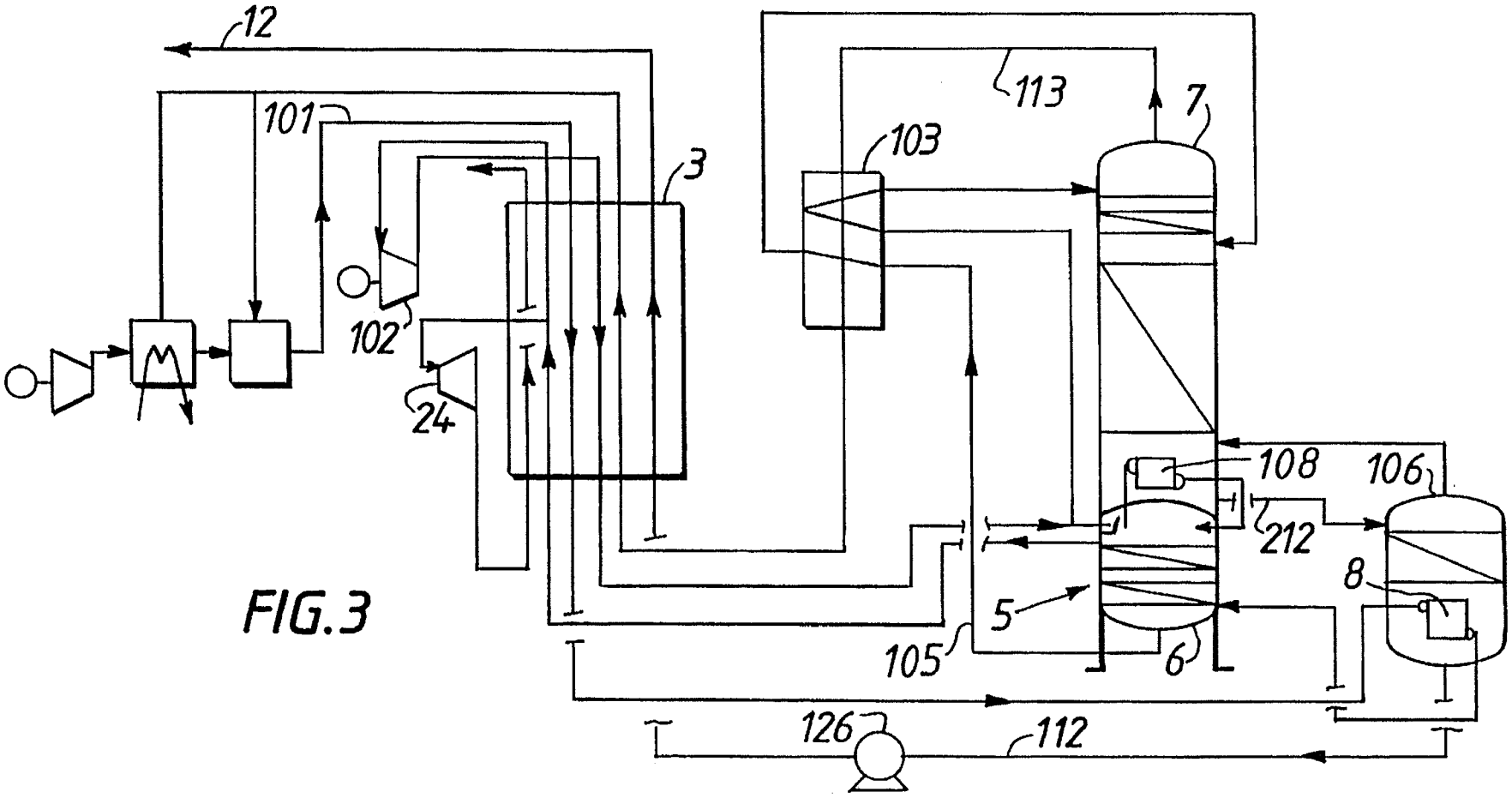

In a modification of the apparatus for practicing the method according to the invention, shown in FIG. 3, all the air partially condenses in the principal vaporizer of the auxiliary column 206, before being sent to the medium pressure column 6.

In this modification, the liquid oxygen withdrawn from the auxiliary column is vaporized in the heat exchange line while condensing the gaseous nitrogen from the head of the medium pressure column reheated and compressed to the vaporization pressure of the oxygen. This liquid nitrogen obtained by condensation is returned to the head of the medium pressure column.

Figure 4:
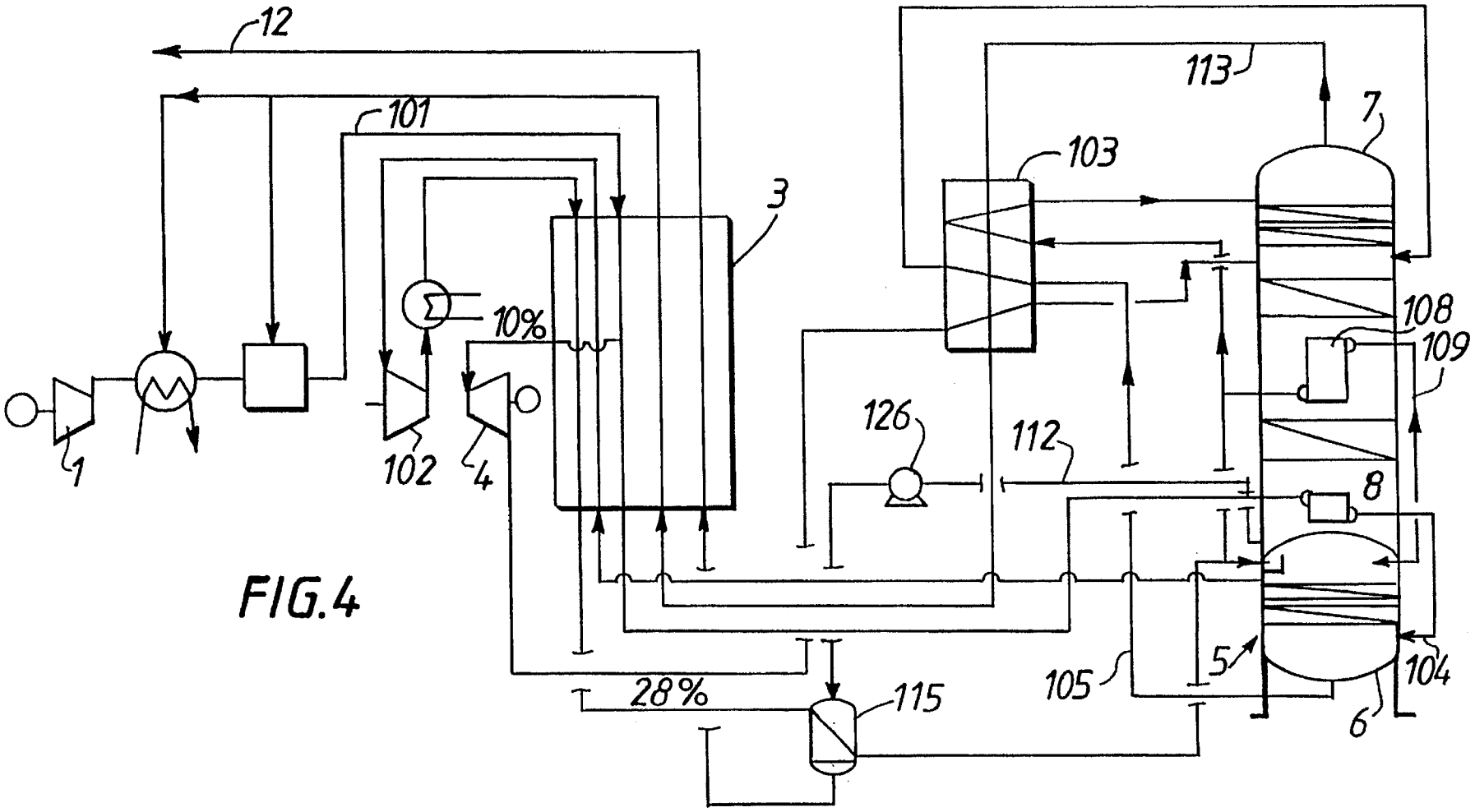

In another modification of apparatus for practicing the invention, shown in FIG. 4, the cold content of the installation is obtained by expansion of a portion of the supplied air in a turbine, coupled to the cycle compressor 102, the expanded air being blown into the low pressure column.

I claim:

1. Process for the production of oxygen by cryogenic distillation of a supply mixture containing oxygen and nitrogen in a double column comprising a medium pressure column and a low pressure column, comprising withdrawing all the oxygen destined to form a gaseous production in liquid phase from the base of the low pressure column, pumping said withdrawn oxygen in liquid phase to a utilization pressure, condensing less than 30% of at least one fraction of the supply mixture in a condenser by vaporization of said liquid oxygen, and sending said partially condensed mixture to the medium pressure column.

2. Process according to claim 1, in which the low pressure column operates in the vicinity of atmospheric pressure.

3. Process according to claim 1, wherein less than 25% of said fraction of the mixture sent to the condenser is condensed.

4. Process according to claim 1, further comprising vaporizing the production oxygen in an auxiliary vaporizer outside the double column.

5. Process according to claim 4, wherein the auxiliary vaporizer is integrated into the exchanger.

6. Process according to claim 4, further comprising vaporizing the production oxygen by a total condensation of a second fraction of the supply mixture.

7. Process according to claim 4, further comprising vaporizing the production oxygen by a total condensation of a mixture enriched in recycled nitrogen, brought to its condensation pressure then introduced into the double column.

8. Process according to claim 1, wherein all the supply mixture destined for the medium pressure column partially condenses in the condenser.

9. Process according to claim 8, in which all the supply mixture condenses partially in the condenser.

* * * * *